US010801457B1

(12) United States Patent
Masti et al.

(10) Patent No.: US 10,801,457 B1
(45) Date of Patent: Oct. 13, 2020

(54) FUEL RAIL ASSEMBLY PROVIDING CONNECTION TO A FUEL INJECTOR

(71) Applicant: DELPHI TECHNOLOGIES IP LIMITED, St. Michael (BB)

(72) Inventors: Ravish S. Masti, Karnataka (IN); Christopher M. Cass, Fairport, NY (US); Curtis D. Lamb, West Henrietta, NY (US)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 16/502,484

(22) Filed: Jul. 3, 2019

(51) Int. Cl.
*F02M 55/00* (2006.01)
*F02M 63/02* (2006.01)
*F02M 55/02* (2006.01)

(52) U.S. Cl.
CPC ..... *F02M 63/028* (2013.01); *F02M 55/025* (2013.01); *F02M 2200/16* (2013.01); *F02M 2200/856* (2013.01)

(58) Field of Classification Search
CPC ..... F02M 63/028; F02M 55/025; F02M 2200/16; F02M 2200/856
USPC ..... 123/456, 470
See application file for complete search history.

(56) References Cited

U.S. PATENT DOCUMENTS 5,667,255 A 9/1997 Kato
6,886,537 B2 * 5/2005 Kondo ..... F02M 55/005 123/456
7,318,418 B2 * 1/2008 Usui ..... F02M 55/005 123/456
7,516,734 B2 * 4/2009 Tominaga ..... F02M 55/025 123/456
7,516,735 B1 4/2009 Doherty et al.
7,523,741 B2 * 4/2009 Kochanowski ..... F02M 55/025 123/456
8,596,246 B2 * 12/2013 Nishizawa ..... F02M 55/025 123/469
2003/0084880 A1 * 5/2003 Boecking ..... F02M 55/025 123/456
2007/0246016 A1 10/2007 Scheffel et al.
(Continued)

FOREIGN PATENT DOCUMENTS

JP 09280374 A 10/1997
JP 10078135 A 3/1998

*Primary Examiner* — Hai H Huynh
(74) *Attorney, Agent, or Firm* — Joshua M. Haines

(57) ABSTRACT

A fuel rail assembly includes a fuel rail having a main conduit with a main fuel passage and a distribution conduit extending away from the main conduit and having a distribution passage extending therethrough which is in fluid communication with the main fuel passage, the distribution conduit having a distribution conduit primary threaded section, a distribution conduit secondary threaded section, and a distribution conduit sealing surface located axially between the distribution conduit primary threaded section and the distribution conduit secondary threaded section. A primary sealing nut threadably engages the distribution conduit secondary threaded section and a secondary sealing nut threadably engages the distribution conduit secondary threaded section. A sealing ring is located within a counterbore of the primary sealing nut or the secondary sealing nut such that the sealing ring circumferentially and sealingly surrounds the distribution conduit sealing surface and a sealing engages a sealing surface of the counterbore.

20 Claims, 7 Drawing Sheets

(56) References Cited

U.S. PATENT DOCUMENTS

| | | | |
|---|---|---|---|
| 2008/0156296 | A1 | 7/2008 | Ochiai |
| 2011/0030656 | A1 | 2/2011 | Pepperine et al. |
| 2016/0273501 | A1 | 9/2016 | Cass et al. |
| 2017/0260946 | A1 | 9/2017 | Suzuki et al. |
| 2017/0350358 | A1 | 12/2017 | Bayer et al. |

* cited by examiner

FUEL RAIL ASSEMBLY PROVIDING CONNECTION TO A FUEL INJECTOR

TECHNICAL FIELD OF INVENTION

The present invention relates to a fuel rail assembly which supplies fuel to a fuel injector of a fuel consuming device, and more particularly to an arrangement which provides a fuel-tight seal between the fuel rail assembly and the fuel injector.

BACKGROUND OF INVENTION

Fuel injection systems that deliver fuel to fuel consuming devices, for example internal combustion engines, have been known for many years. In modern internal combustion engines, it is increasingly common to provide fuel injectors which inject fuel, for example gasoline, directly into combustion chambers of the internal combustion engine. These internal combustion engines commonly include multiple combustion chambers, and consequently, each combustion chamber is provided with a respective fuel injector to inject fuel therein. A common conduit, typically referred to as a fuel rail, includes an inlet which receives fuel from a fuel source, such as one or more fuel pumps, and also includes a plurality of outlets, each of which is connected to a respective one of the fuel injectors.

In one known arrangement shown in United States Patent Application Publication No. US 2017/0350358 to Bayer et al., the fuel injector is received within a stepped bore of a cylinder head of the internal combustion engine. The stepped bore includes a shoulder which axially supports the fuel injector such that an intermediate member or an isolator may be axially positioned between the fuel injector and the shoulder. An inlet end of the fuel injector is received within a connecting pipe of the fuel rail in order for the fuel injector to receive fuel from the fuel rail. A hold-down device in the form of a spring clip is provided between the connecting pipe and the fuel injector such that the hold-down device urges, and holds, the fuel injector into place against the shoulder of the stepped bore of the cylinder head. In order to seal the connection between the connecting pipe and the inlet end of the fuel injector, an elastomeric O-ring is placed radially between the connecting pipe and the inlet end of the fuel injector. Due to the high fuel pressure exerted on the elastomeric O-ring, a backup ring is included to provide axial support to the elastomeric O-ring, thereby minimizing the likelihood of the elastomeric O-ring being extruded due to the high fuel pressures. However, degradation of the elastomeric O-ring may occur due to extreme pressures, i.e. greater than 35 MPa, and extreme temperature operating range, i.e. −40° C. to 200° C. Furthermore, the elastomeric O-ring is susceptible to cuts, cracks, splits, abrasion, and wear during manufacture, assembly, and operation which may provide undesirable performance.

What is needed is a fuel rail assembly which provides a connection to a fuel injector which minimizes or eliminates one or more of the shortcomings set forth above.

SUMMARY OF THE INVENTION

Briefly described, a fuel rail assembly is provided which supplies fuel to a fuel injector of a fuel consuming device and which is configured to be fixed to the fuel consuming device. The fuel rail assembly includes a fuel rail having 1) a fuel rail main conduit with a main fuel passage defined therein which is configured to receive fuel from a fuel source and 2) a fuel rail distribution conduit extending away from the fuel rail main conduit along a fuel rail distribution conduit axis, the fuel rail distribution conduit having a distribution passage extending therethrough which is in fluid communication with the main fuel passage, the fuel rail distribution conduit having a distribution conduit primary threaded section which is distal from the fuel rail main conduit, a distribution conduit secondary threaded section which is proximal to the fuel rail main conduit, and a distribution conduit sealing surface located axially between the distribution conduit primary threaded section and the distribution conduit secondary threaded section; a primary sealing nut which includes a primary sealing nut bore extending therethrough along the fuel rail distribution conduit axis, the primary sealing nut extending from a primary sealing nut first end which is proximal to the fuel rail main conduit to a primary sealing nut second end which is distal from the fuel rail main conduit, the primary sealing nut bore having 1) a primary sealing nut bore threaded section which threadably engages the distribution conduit primary threaded section and 2) a primary sealing nut bore primary sealing surface located between the primary sealing nut bore threaded section and the primary sealing nut second end and configured to sealingly mate with the fuel injector when the primary sealing nut is rotated to cause the primary sealing nut to move away from the fuel rail main conduit; a secondary sealing nut which includes a secondary sealing nut bore extending therethrough along the fuel rail distribution conduit axis, the secondary sealing nut extending from a secondary sealing nut first end which is proximal to the fuel rail main conduit to a secondary sealing nut second end which is distal from the fuel rail main conduit, the secondary sealing nut bore having a secondary sealing nut bore threaded section which threadably engages the distribution conduit secondary threaded section; and a sealing ring located within a counterbore of one of the primary sealing nut bore and the secondary sealing nut bore such that the sealing ring circumferentially surrounds the fuel rail distribution conduit, wherein the secondary sealing nut is configured to compress the sealing ring within the counterbore when the secondary sealing nut is rotated to cause the secondary sealing nut to move toward the primary sealing nut, thereby causing the sealing ring to sealingly engage the distribution conduit sealing surface and the primary sealing nut.

A fuel system is also provided for supplying fuel to a fuel consuming device. The fuel system includes a fuel injector having a fuel injector inlet conduit, a nozzle opening, and a valve needle which is moveable to selectively permit and prevent flow of fuel from the fuel injector inlet conduit through the nozzle opening; and a fuel rail assembly. The fuel rail assembly includes a fuel rail having 1) a fuel rail main conduit with a main fuel passage defined therein which is configured to receive fuel from a fuel source and 2) a fuel rail distribution conduit extending away from the fuel rail main conduit along a fuel rail distribution conduit axis, the fuel rail distribution conduit having a distribution passage extending therethrough which is in fluid communication with the main fuel passage, the fuel rail distribution conduit having a distribution conduit primary threaded section which is distal from the fuel rail main conduit, a distribution conduit secondary threaded section which is proximal to the fuel rail main conduit, and a distribution conduit sealing surface located axially between the distribution conduit primary threaded section and the distribution conduit secondary threaded section; a primary sealing nut which includes a primary sealing nut bore extending therethrough along the fuel rail distribution conduit axis, the primary sealing nut extending from a primary sealing nut first end which is proximal to the fuel rail main conduit to a primary sealing nut second end which is distal from the fuel rail main conduit, the primary sealing nut bore having 1) a primary sealing nut bore threaded section which threadably engages the distribution conduit primary threaded section and 2) a primary sealing nut bore primary sealing surface located between the primary sealing nut bore threaded section and the primary sealing nut second end and configured to sealingly mate with a fuel injector inlet conduit sealing surface of the fuel injector inlet conduit when the primary sealing nut is rotated to cause the primary sealing nut to move away from the fuel rail main conduit; a secondary sealing nut which includes a secondary sealing nut bore extending therethrough along the fuel rail distribution conduit axis, the secondary sealing nut extending from a secondary sealing nut first end which is proximal to the fuel rail main conduit to a secondary sealing nut second end which is distal from the fuel rail main conduit, the secondary sealing nut bore having a secondary sealing nut bore threaded section which threadably engages the distribution conduit secondary threaded section; and a sealing ring located within a counterbore of one of the primary sealing nut bore and the secondary sealing nut bore such that the sealing ring circumferentially surrounds the fuel rail distribution conduit, wherein the secondary sealing nut is configured to compress the sealing ring within the counterbore when the secondary sealing nut is rotated to cause the secondary sealing nut to move toward the primary sealing nut, thereby causing the sealing ring to sealingly engage the distribution conduit sealing surface and the primary sealing nut.

A fuel rail assembly is also provided which supplies fuel to a fuel injector of a fuel consuming device and which is configured to be fixed to the fuel consuming device. The fuel rail assembly includes a fuel rail having 1) a fuel rail main conduit with a main fuel passage defined therein which is configured to receive fuel from a fuel source and 2) a fuel rail distribution conduit extending away from the fuel rail main conduit along a fuel rail distribution conduit axis, the fuel rail distribution conduit having a distribution passage extending therethrough which is in fluid communication with the main fuel passage, the fuel rail distribution conduit having a distribution conduit primary threaded section which is distal from the fuel rail main conduit, a distribution conduit secondary threaded section which is proximal to the fuel rail main conduit, and a distribution conduit sealing surface located axially between the distribution conduit primary threaded section and the distribution conduit secondary threaded section.

The fuel rail assemblies and fuel system as disclosed herein allows for metal-to-metal interfaces which provide the sealing necessary to withstand the high fuel pressures experienced during operation, without the need to rely on elastomeric seals which are susceptible to cuts, cracks, splits, abrasion, and wear during manufacture, assembly. Furthermore, accommodates angular misalignment between the fuel injector and the fuel rail assembly is accommodated while still maintaining the fuel-tight seal between the fuel rail assembly and the fuel injector.

BRIEF DESCRIPTION OF DRAWINGS

This invention will be further described with reference to the accompanying drawings in which.

DETAILED DESCRIPTION OF INVENTION

Figure 1:
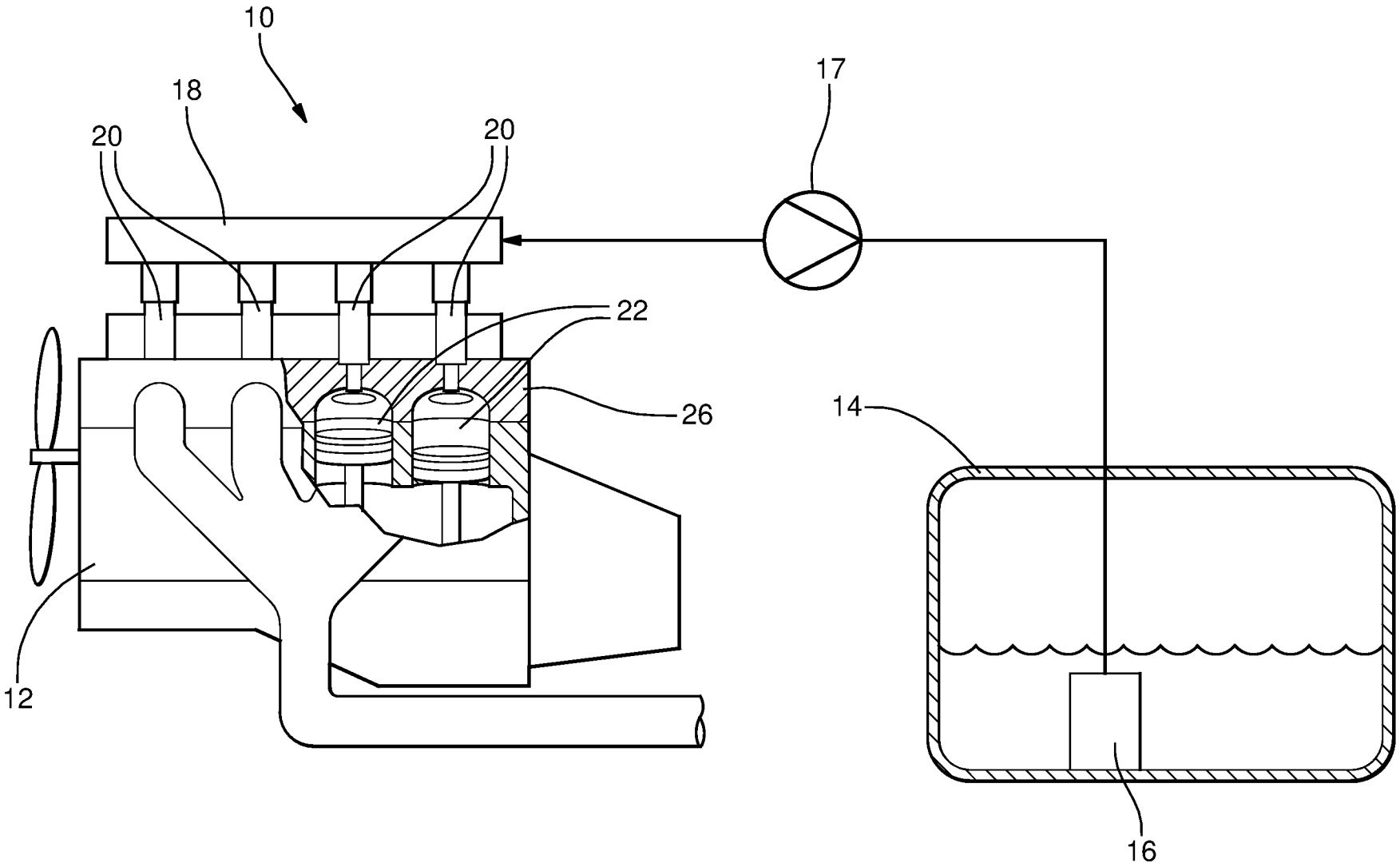
FIG. 1 is a schematic view of a fuel system in accordance with the present disclosure.
Figure 2:
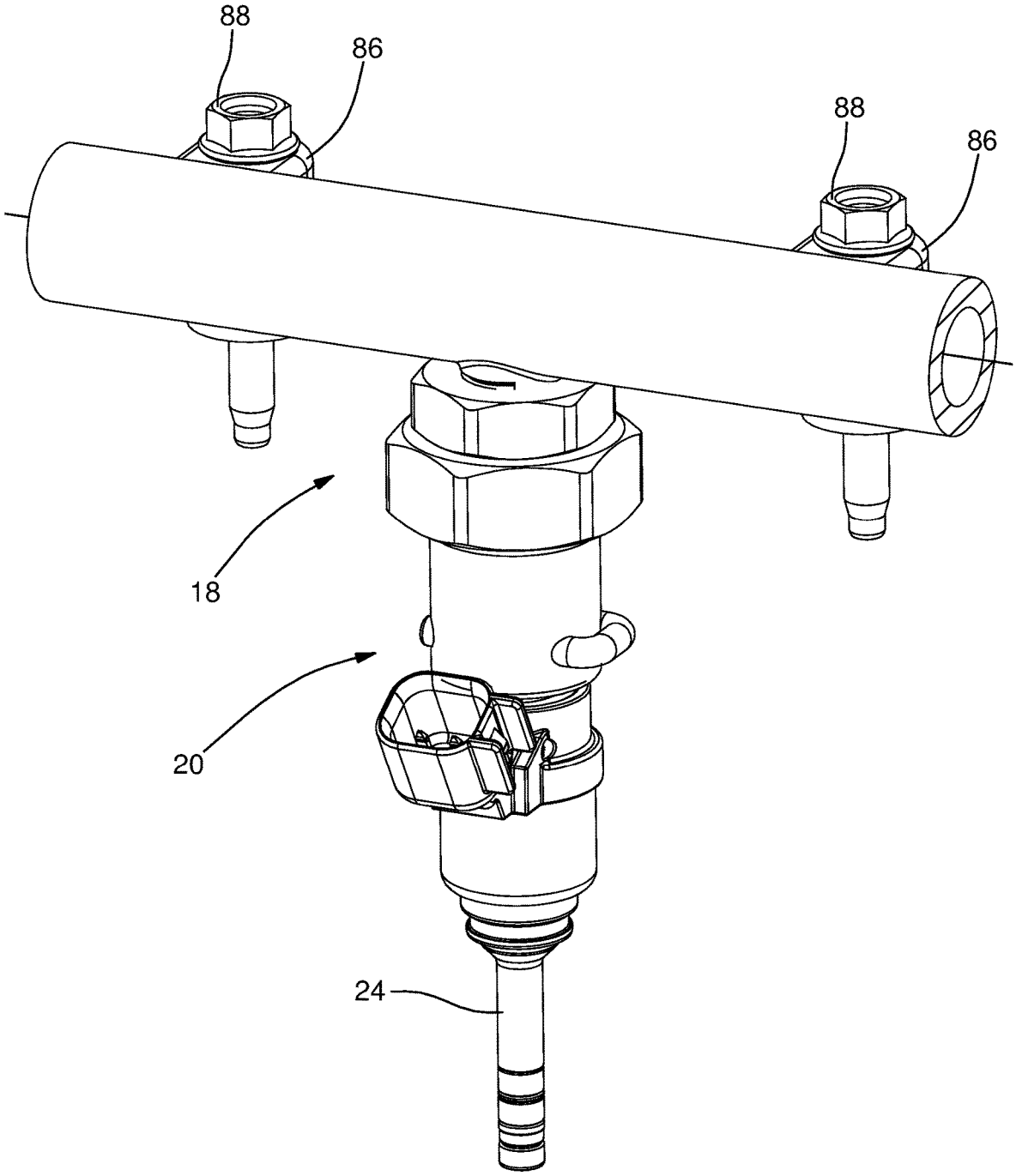
FIG. 2 is an isometric view of a fuel rail assembly and a fuel injector in accordance with the present disclosure.
Figure 3:
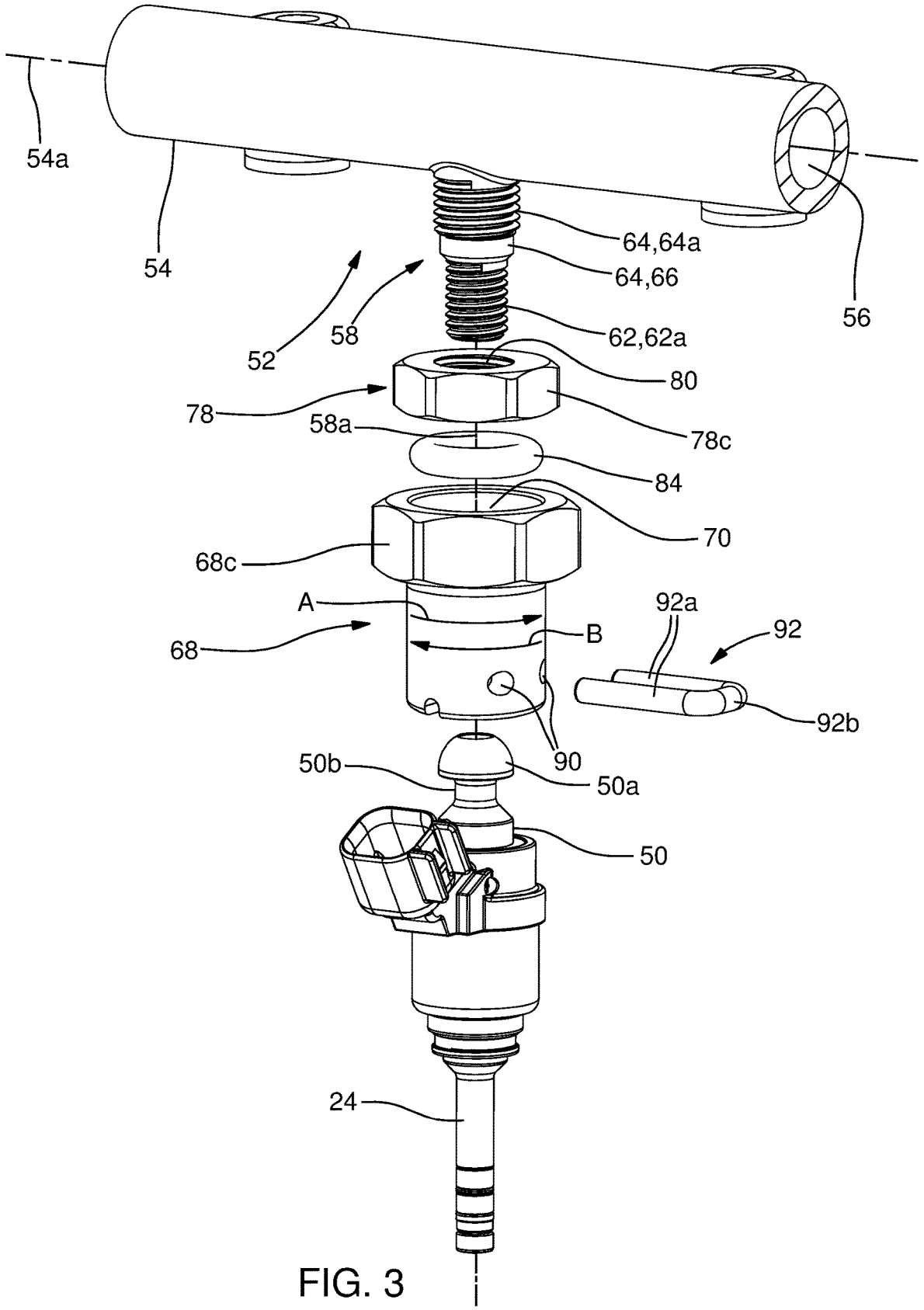
FIG. 3 is an exploded view of FIG. 2.

Referring initially to FIG. 1, a fuel system 10 is shown in simplified schematic form for supplying fuel to a fuel consuming device, for example an internal combustion engine 12, by way of non-limiting example only, for a motor vehicle. Fuel system 10 includes a fuel tank 14 for storing a volume of fuel, a low-pressure fuel pump 16 which may be located within fuel tank 14 as shown, a high-pressure fuel pump 17 which receives fuel from low-pressure fuel pump 16, a fuel rail assembly 18 attached to internal combustion engine 12 and in fluid communication with high-pressure fuel pump 17, and a plurality of fuel injectors 20 in fluid communication with fuel rail assembly 18. In operation, low-pressure fuel pump 16 draws fuel from fuel tank 14 and pumps the fuel to high-pressure fuel pump 17 under relatively low pressure, for example about 500 kPa. High-pressure fuel pump 17, which may be a piston pump operated by a cam of internal combustion engine 12, further pressurizes the fuel and supplies the fuel to fuel rail assembly 18 under relatively high pressure, for example, above about 14 MPa and even reaching 35 MPa or higher. Each fuel injector 20 receives fuel from fuel rail assembly 18 and injects the fuel into a respective combustion chamber 22 of internal combustion engine 12 for combustion of the fuel within combustion chambers 22.

Figure 4:
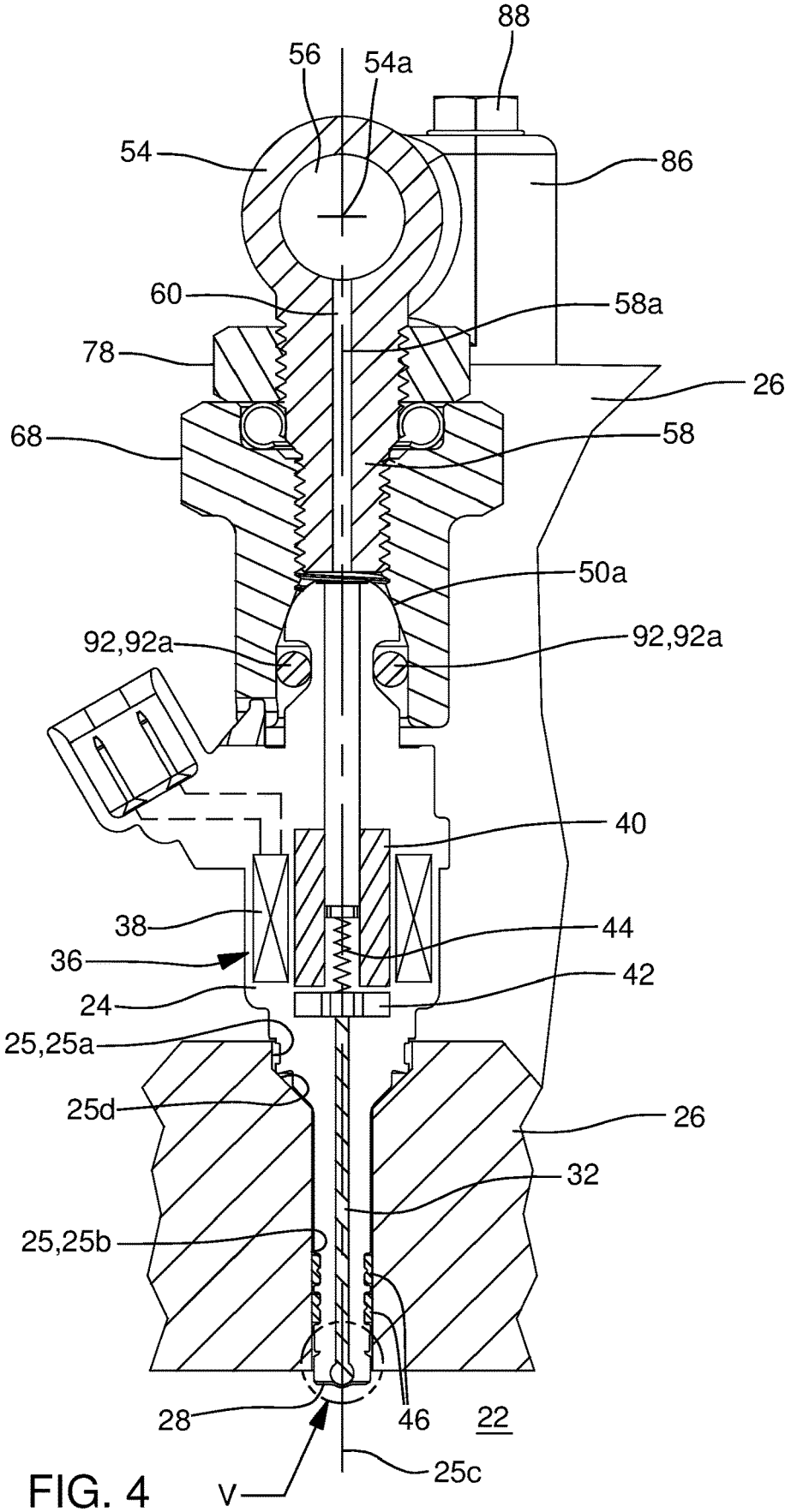
FIG. 4 is an axial cross-sectional view of the fuel rail assembly of FIG. 2.
Figure 5:
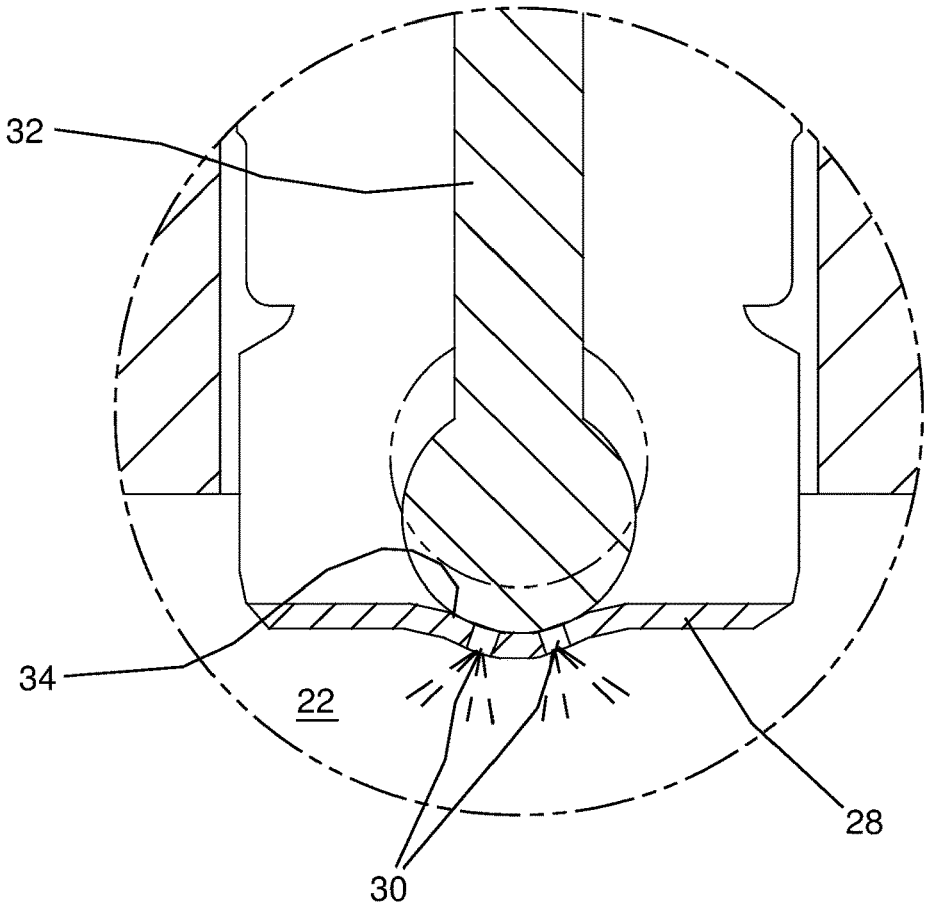
FIG. 5 is an enlarge view of circle V of FIG. 4.

Referring now to FIGS. 4 and 5, fuel injector 20, the internal working of which are shown in schematic form only in FIG. 4, includes a fuel injector body 24 which is configured to be inserted into a fuel injector receiving bore 25 of a cylinder head 26 of internal combustion engine 12 such that a nozzle tip 28 of fuel injector body 24 communicates with combustion chamber 22 and includes one or more nozzle openings 30 therein from which fuel is selectively discharged from fuel injector 20 into combustion chamber 22. The discharge of fuel from nozzle openings 30 is controlled by a valve needle 32 located within fuel injector body 24 where valve needle 32 is selectively seated with a valve seat 34 (valve needle 32 being shown in solid lines in FIG. 5) to stop discharge of fuel through nozzle openings 30 and is selectively unseated with valve seat 34 (valve needle 32 being shown in phantom lines in FIG. 5) to discharge fuel from fuel injector 20 into combustion chamber 22. Movement of valve needle 32 is controlled by an actuator 36, illustrated herein as a solenoid actuator. As embodied herein, actuator 36 includes a wire winding 38, a pole piece 40 which is stationary, an armature 42 which is moveable with valve needle 32, and a return spring 44 which urges valve needle 32 in a direction to be seated with valve seat 34. When wire winding 38 is energized with an electric current, armature 42 is magnetically attracted to pole piece 40, thereby unseating valve needle 32 from valve seat 34. Conversely, when the electric current to wire winding 38 is stopped, the magnetic attraction between armature 42 and pole piece 40 is stopped, thereby allowing return spring 44 to move valve needle 32 to be seated with valve seat 34. While actuator 36 has been illustrated herein as a solenoid actuator, it should be understood that actuator 36 may take other forms, which may be, by way of non-limiting example only, a piezoelectric actuator. Furthermore, while actuator 36 has been illustrated as directly actuating valve needle 32, it should be understood that actuator 36 may be indirect acting such that the actuator may be used to control fuel pressure in a control chamber such that the fuel pressure in the control chamber affects the position of valve needle 32. Fuel injector 20 includes a fuel injector inlet conduit 50 which receives fuel from fuel rail assembly 18 for selective injection into combustion chamber 22 such that fuel injector inlet conduit 50 includes a fuel injector inlet conduit sealing surface 50*a* which is configured to sealingly mate with fuel rail assembly 18 as will be described in greater detail later. Fuel injector inlet conduit 50 is made of a metal material, and may preferably be stainless steel in order to minimize or prevent corrosion due to contact with corrosive fuels such as gasoline. Fuel injector inlet conduit sealing surface 50*a* is preferably frustospherical in shape, i.e. a frustum of a sphere, which allows for misalignment between fuel injector 20 and fuel rail assembly 18.

Fuel injector receiving bore 25 is a stepped bore which includes at least two sections of distinct diameter such that a fuel injector receiving bore outer portion 25*a* is distal from combustion chamber 22 and such that a fuel injector receiving bore inner portion 25*b* is proximal to combustion chamber 22. Fuel injector receiving bore outer portion 25*a* and fuel injector receiving bore inner portion 25*b* are each centered about a fuel injector receiving bore axis 25*c*, however, fuel injector receiving bore outer portion 25*a* is larger in diameter than fuel injector receiving bore inner portion 25*b*. Fuel injector 20 includes one or more combustion seals 46 which are disposed radially between fuel injector body 24 and fuel injector receiving bore inner portion 25*b*, thereby preventing combustion gases from passing between the interface of fuel injector body 24 and fuel injector receiving bore inner portion 24*b*. A fuel injector receiving bore shoulder 25*d* is formed between fuel injector receiving bore outer portion 25*a* and fuel injector receiving bore inner portion 25*b* such that fuel injector receiving bore shoulder 25*d* is perpendicular, inclined, or a combination of perpendicular and inclined to fuel injector receiving bore axis 25*c*. Fuel injector 20 is axially supported by fuel injector receiving bore shoulder 25*d* and held in compression between fuel rail assembly 18 and fuel injector receiving bore shoulder 25*d* as will be described in greater detail later. Optionally, a fuel injector isolator (not shown) may be provided axially between fuel injector receiving bore shoulder 25*d* and fuel injector 20 in order to provide thermal and vibration resistance between fuel injector 20 and cylinder head 26.

Now with reference to FIGS. 2-9, fuel rail assembly 18 includes a fuel rail 52 (only a portion of which is shown) with a fuel rail main conduit 54 which extends along a fuel rail main conduit axis 54*a*. Fuel rail main conduit 54 is tubular, thereby defining a main fuel passage 56 therein which receives high-pressure fuel from high-pressure fuel pump 17. Fuel rail 52 also includes a plurality of fuel rail distribution conduits 58 (only one fuel rail distribution conduit 58 is shown in FIGS. 2-4 and 6), one for each fuel injector 20, extending away from fuel rail main conduit 54. Each fuel rail distribution conduit 58 is substantially identical, and consequently, fuel rail distribution conduit 58 and respective elements interfacing therewith for making connection to a respective fuel injector 20 will be referred to in singular form with the understanding that the description applies equally to the connections to each fuel injector 20. Fuel rail distribution conduit 58 extends away from fuel rail main conduit 54 along a fuel rail distribution conduit axis 58*a* which is preferably perpendicular to fuel rail main conduit axis 54*a*. Fuel rail distribution conduit axis 58*a* for each fuel rail distribution conduit 58 is preferably parallel to every other fuel rail distribution conduit axis 58*a* of every other fuel rail distribution conduit 58 of fuel rail 52. Fuel rail distribution conduit 58 includes a distribution passage 60 extending therethrough which is in fluid communication with main fuel passage 56 and is also in fluid communication with fuel injector inlet conduit 50. In this way, fuel is communicated from main fuel passage 56 to fuel injector inlet conduit 50 via distribution passage 60 for injection of fuel into combustion chamber 22. Fuel rail 52 (including fuel rail main conduit 54 and fuel rail distribution conduit 58) is made of a metal material, and may preferably be stainless steel in order to minimize or prevent corrosion due to contact with corrosive fuels such as gasoline.

An outer periphery of fuel rail distribution conduit 58 includes a fuel rail distribution conduit primary threaded section 62 which is distal from fuel rail main conduit 54 and which includes fuel rail distribution conduit primary threads 62*a*. The outer periphery of fuel rail distribution conduit 58 also includes a fuel rail distribution conduit secondary threaded section 64 which is proximal to fuel rail main conduit 54 and which includes fuel rail distribution conduit secondary threads 64*a*. Fuel rail distribution conduit secondary threads 64*a* are larger in diameter than fuel rail distribution conduit primary threads 62*a*. The outer periphery of fuel rail distribution conduit 58 also includes a fuel rail distribution conduit sealing surface 66 which is cylindrical and centered about fuel rail distribution conduit axis 58*a* and which is located axially between fuel rail distribution conduit primary threaded section 62 and fuel rail distribution conduit secondary threaded section 64.

Fuel rail assembly 18 also includes a primary sealing nut 68 having a primary sealing nut bore 70 extending therethrough along fuel rail distribution conduit axis 58*a*. Primary sealing nut 68 is made of a metal material, and may preferably be stainless steel in order to minimize or prevent corrosion due to contact with corrosive fuels such as gasoline. Primary sealing nut 68 extends from a primary sealing nut first end 68*a* which is proximal to fuel rail main conduit 54 to a primary sealing nut second end 68*b* which is distal from fuel rail main conduit 54. Primary sealing nut bore 70 includes a primary sealing nut bore threaded section 72 having primary nut bore threads 72*a* which are complementary to fuel rail distribution conduit primary threads 62*a* such that primary sealing nut bore threaded section 72 threadably engages fuel rail distribution conduit primary threaded section 62. Primary sealing nut bore 70 also includes a primary sealing nut bore primary sealing surface 74 located between primary sealing nut bore threaded section 72 and primary sealing nut second end 68*b*. Primary sealing nut bore primary sealing surface 74 is configured to sealingly mate with fuel injector inlet conduit sealing surface 50*a*, thereby preventing fuel leakage between the interface of fuel injector inlet conduit 50 and primary sealing nut 68 when primary sealing nut 68 is rotated to cause primary sealing nut 68 to move away from fuel rail main conduit 54 which presses primary sealing nut bore primary sealing surface 74 against fuel injector inlet conduit sealing surface 50*a*. Primary sealing nut bore primary sealing surface 74 is preferably frustoconical in shape as shown or alternatively frustospherical, thereby allowing for angular mismatch between fuel injector 20 and fuel rail distribution conduit 58, while still preventing fuel leakage between the interface of fuel injector inlet conduit 50 and primary sealing nut 68. Primary sealing nut bore 70 also includes a primary sealing nut counterbore 76 located between primary sealing nut bore threaded section 72 and primary sealing nut first end 68*a*. Primary sealing nut counterbore 76 includes a primary sealing nut counterbore end surface 76*a* which is travers to fuel rail distribution conduit axis 58*a* and which is preferably perpendicular to fuel rail distribution conduit axis 58*a*. Primary sealing nut counterbore 76 also includes a primary sealing nut counterbore peripheral surface 76*b* which joins primary sealing nut counterbore end surface 76*a* to primary sealing nut first end 68*a* such that primary sealing nut counterbore peripheral surface 76*b* circumferentially surrounds fuel rail distribution conduit axis 58*a* and is preferably cylindrical in shape. In an alternative arrangement, primary sealing nut counterbore 76 may be omitted and a similar counterbore may be provided in secondary sealing nut 78 such that the counterbore is located between secondary sealing nut second end 78*b* and secondary sealing nut bore threaded section 82. An outer periphery of primary sealing nut 68 includes features, illustrated herein by way of non-limiting example only as a primary sealing nut hexagon periphery 68*c*, which is configured to mate with a tool such as a wrench (not shown) for tightening primary sealing nut 68 to fuel injector 20 during assembly as will be described in greater detail later.

Fuel rail assembly 18 also includes a secondary sealing nut 78 having a secondary sealing nut bore 80 extending therethrough along fuel rail distribution conduit axis 58*a*. Secondary sealing nut 78 is made of a metal material, may preferably be stainless steel in order to be compatible with fuel rail distribution conduit 58 and primary sealing nut 68 which are each preferably made of stainless steel. Secondary sealing nut 78 extends from a secondary sealing nut first end 78*a* which is proximal to fuel rail main conduit 54 to a secondary sealing nut second end 78*b* which is distal from fuel rail main conduit 54. Secondary sealing nut bore 80 includes a secondary sealing nut bore threaded section 82 having secondary sealing nut bore threads 82*a* which are complementary to fuel rail distribution conduit secondary threads 64*a* such that secondary sealing nut bore threaded section 82 threadably engages fuel rail distribution conduit secondary threaded section 64. An outer periphery of secondary sealing nut 78 includes features, illustrated herein by way of non-limiting example only as a secondary sealing nut hexagon periphery 88*c*, which is configured to mate with a tool such as a wrench (not shown) for tightening primary sealing nut 68 during assembly as will be described in greater detail later.

Fuel rail assembly 18 also includes a sealing ring 84 located within primary sealing nut counterbore 76 and circumferentially surrounding fuel rail distribution conduit 58 such that sealing ring 84 prevents fuel that may have leaked past the interface of primary sealing nut bore threaded section 72 and secondary sealing nut bore threaded section 82 from passing to the atmosphere, i.e. outside of fuel rail assembly 18 and fuel injector 20. Sealing ring 84 is made of a metal material, and may preferably be stainless steel in order to minimize or prevent corrosion due to contact with corrosive fuels such as gasoline. In order to ensure proper sealing, sealing ring 84 is sized to be compressed axially, i.e. parallel to fuel rail distribution conduit axis 58*a*, by primary sealing nut 68 and secondary sealing nut 78 when secondary sealing nut 78 is rotated to cause secondary sealing nut 78 to move toward primary sealing nut 68, thereby causing sealing ring 84 to be axially compressed by primary sealing nut counterbore end surface 76*a* and secondary sealing nut second end 78*b*. This axial compression of sealing ring 84 is preferably an elastic deflection which results in radial inward and radial outer expansion, i.e. radial relative to fuel rail distribution conduit axis 58*a*, of sealing ring 84 which provides radial compression circumferentially between sealing ring 84 and fuel rail distribution conduit sealing surface 66 and also provides radial compression circumferentially between sealing ring 84 and primary sealing nut counterbore peripheral surface 76*b*. Consequently, sealing ring 84 sealingly engages fuel rail distribution conduit sealing surface 66, thereby preventing fuel from passing therebetween and also sealingly engages primary sealing nut 68, thereby preventing fuel from passing therebetween. It should be noted that sealing engagement between sealing ring 84 and primary sealing nut 68 may be at only one of the interfaces of sealing ring 84 and primary sealing nut 68, i.e. axially at sealing ring 84 and primary sealing nut counterbore end surface 76*a* or radially at sealing ring 84 and primary sealing nut counterbore peripheral surface 76*b*, or may be at both interfaces of sealing ring 84 and primary sealing nut 68. Consequently, if fuel is able to leak past the interface of sealing ring 84 and primary sealing nut counterbore end surface 76*a*, the interface of sealing ring 84 and primary sealing nut counterbore peripheral surface 76*b* is able to prevent leakage of the fuel to the atmosphere.

Figure 9:
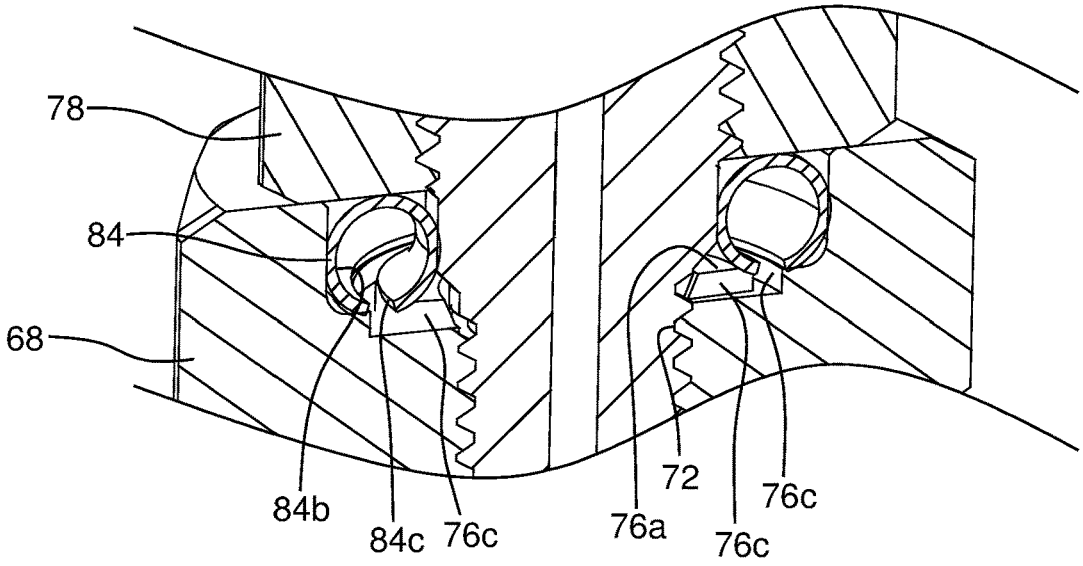
FIG. 9 is a, isometric cross-sectional view of a portion of a primary sealing nut, a secondary sealing nut, and a fuel rail distribution conduit.
Figure 6:
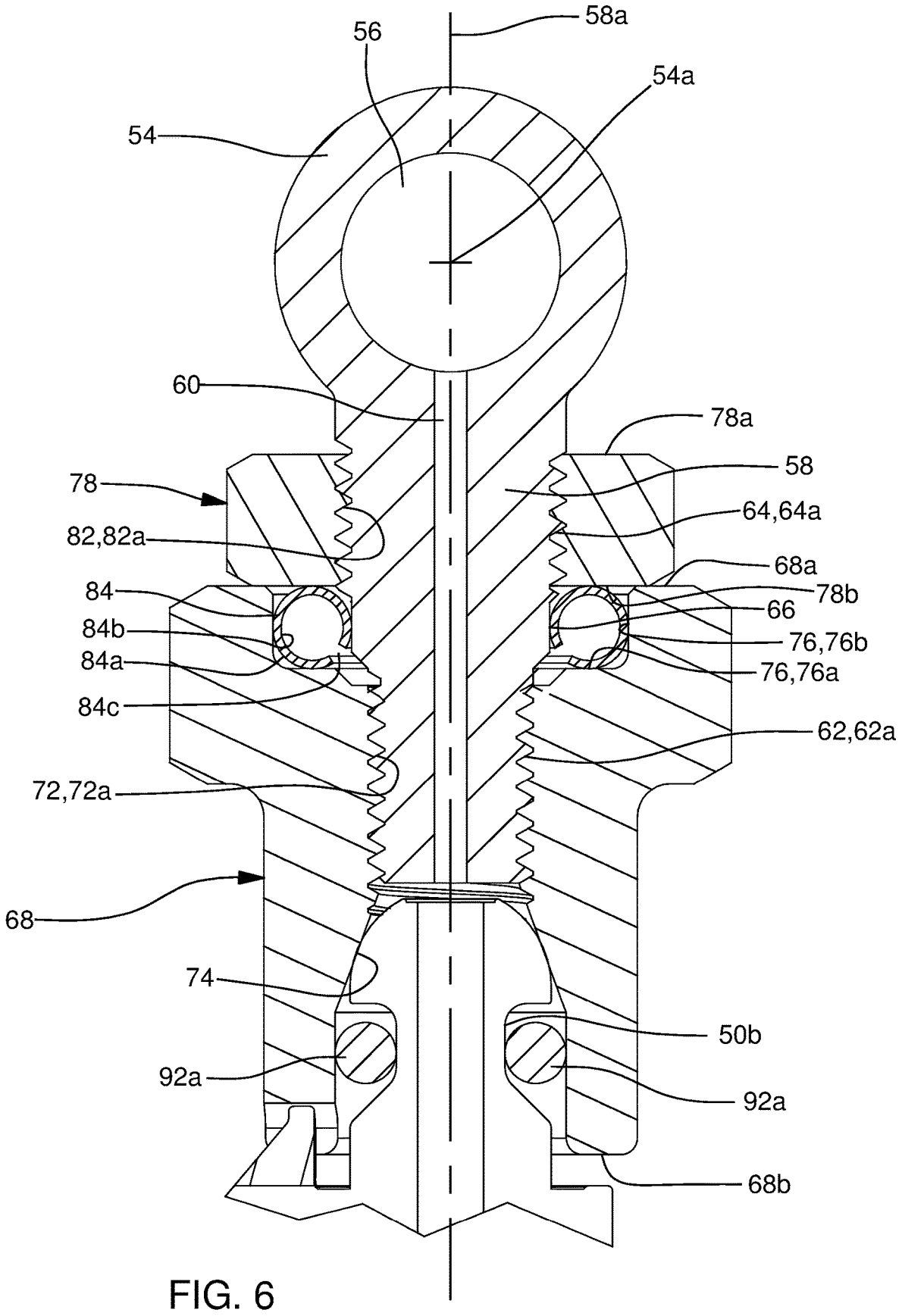
FIG. 6 is an enlarged portion of 4 showing the connection between the fuel rail assembly and the fuel injector.
Figure 7:
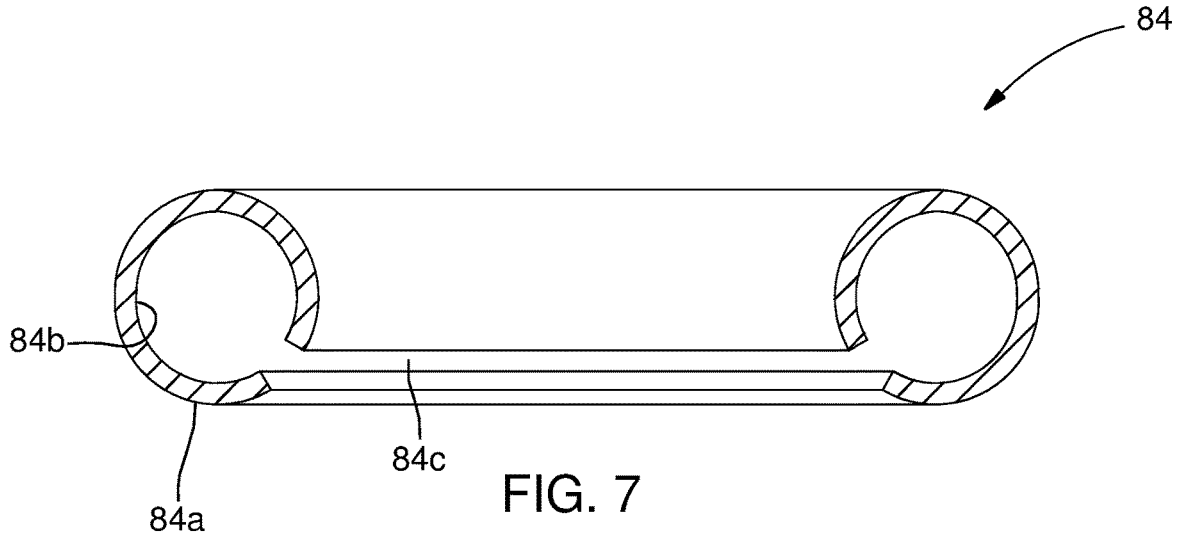
FIG. 7 is an enlarged cross-sectional view of a sealing ring of the fuel rail assembly.
Figure 8:
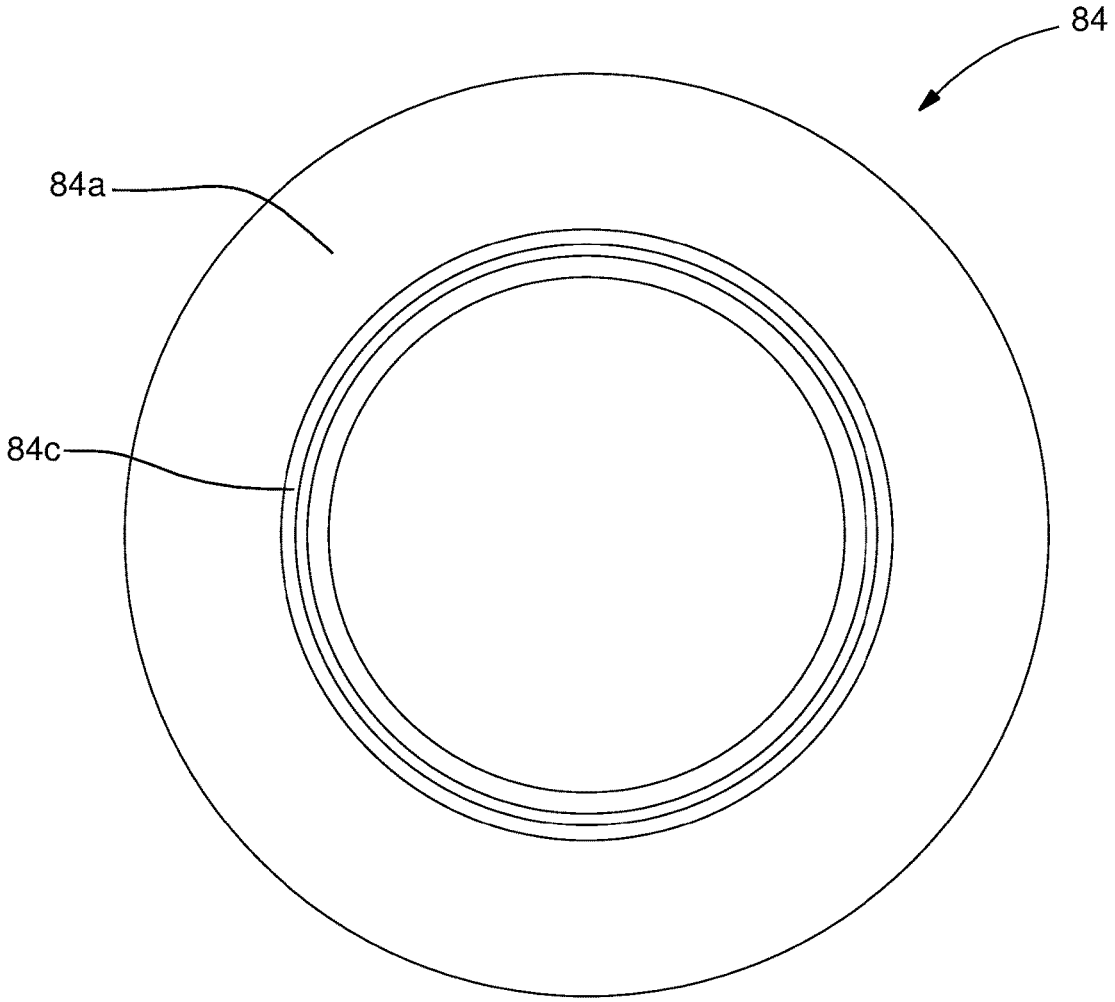
FIG. 8 is an end view of the sealing ring of FIG. 7.

Sealing ring 84 may be hollow as shown, thereby sealing ring 84 being a hollow toroid having a sealing ring outer surface 84*a* and a sealing ring inner surface 84*b*. Also as shown, sealing ring 84 may include a sealing ring slot 84*c* extending from sealing ring outer surface 84*a* to sealing ring inner surface 84*b* such that sealing ring slot 84*c* is annular in shape and centered about fuel rail distribution conduit axis 58*a*. Sealing ring 84 may be referred to as a C-ring as a result of the axial cross-sectional shape of sealing ring 84 at one radial location being in the shape of a "C" as shown in FIGS. 6 and 7. Sealing ring slot 84*c* is oriented within primary sealing nut counterbore 76 to provide fluid communication between primary sealing nut bore threaded section 72 and sealing ring inner surface 84*b*. Consequently, pressure is able to act on the interior of sealing ring 84 which causes forces which tent to expand sealing ring 84, thereby further enhancing sealing between sealing ring 84 and fuel rail distribution conduit sealing surface 66 and between sealing ring 84 and primary sealing nut 68. As illustrated herein, sealing ring slot 84*c* may be oriented on sealing ring 84 to be approximately midway between radially inward and axially downward where approximately midway includes a range of being centered at 45°±25° between radially inward and axially downward. Alternatively, as illustrated in FIG. 9, sealing ring slot 84*c* may be oriented to be axially downward, however, in this orientation, primary sealing nut counterbore end surface 76*a* will need one or more grooves 76*c* formed therein to provide a path to allow for fluid communication between primary sealing nut bore threaded section 72 and sealing ring inner surface 84*b*. As illustrated in FIG. 9, one groove 76*c* may be annular in shape and axially aligned with sealing ring slot 84*c* while two or more other grooves 76*c* extend radially inward from groove 76*c*. In an alternative arrangement, sealing ring 84 may be solid, rather than hollow, while still being configured to elastically deform in a similar manner to sealing ring 84 which is hollow. However, when sealing ring 84 is solid, there is no internal volume to receive pressurized fuel that may be used to expand sealing ring 84 to enhance sealing. In yet another alternative, sealing ring 84 may remain hollow, but sealing ring slot 84*c* may be omitted, thereby forming a sealed chamber therein. In still yet another alternative, sealing ring 84 may include a spring within the hollow interior defined by sealing ring inner surface 84*b*. This spring adds to the force directed outward when compressed for sealing against one or more of primary sealing nut counterbore end surface 76*a*, secondary sealing nut second end 78*b*, fuel rail distribution conduit sealing surface 66, and primary sealing nut counterbore peripheral surface 76*b*.

In order to secure fuel rail 52 to internal combustion engine 12, fuel rail 52 includes fuel rail mounting bosses 86 which are fixed to fuel rail main conduit 54 for example by being formed integrally with fuel rail main conduit 54 or by being formed separately from fuel rail main conduit 54 and subsequently fixed thereto, for example, by welding. Each fuel rail mounting boss 86 receives a respective fuel rail mounting bolt 88 therethrough which threadably engages (not shown) cylinder head 26, consequently, fuel rail mounting bolts 88 are tightened to clamp fuel rail assembly 18 to internal combustion engine 12/cylinder head 26.

In order to retain fuel injector 20 to fuel rail assembly 18 before being installed to internal combustion engine 12, primary sealing nut 68 includes retention bores 90 which are parallel to each other and which extend into primary sealing nut 68 in a direction that is normal to fuel rail distribution conduit axis 58*a*. Retention bores 90 extend from the outer periphery of primary sealing nut 68 and break into primary sealing nut bore 70 at a location axially between primary sealing nut bore primary sealing surface 74 and primary sealing nut second end 68*b* such that retention bores 90 are aligned with a fuel injector inlet conduit retention groove 50*b* which extends radially into the outer periphery of fuel injector inlet conduit 50. A retention pin 92 which is U-shaped includes retention pin legs 92*a* which are parallel to each other and connected at one end by a retention pin connecting segment 92*b*. Free ends of retention pin legs 92*a* are inserted into respective ones of retention bores 90 such that each retention pin leg 92*a* extends into fuel injector inlet conduit retention groove 50*b*, thereby capturing fuel injector inlet conduit 50 within primary sealing nut bore 70 and retaining fuel injector 20 to fuel rail assembly 18. However, it is important to note that after fuel rail assembly 18 and fuel injector 20 have been installed on internal combustion engine 12, retention bores 90 and retention pin 92 do not serve a function.

Steps involved with assembly of fuel rail assembly 18 and assembly of fuel rail assembly 18 and fuel injector 20 to internal combustion engine 12 will now be described. In a first step, secondary sealing nut 78 is threaded onto fuel rail distribution conduit secondary threaded section 64 in the direction of arrow A in FIG. 3 which is followed by primary sealing nut 68, with sealing ring 84 already installed within primary sealing nut counterbore 76, being threaded onto fuel rail distribution conduit primary threaded section 62 in the direction of arrow A. Next, fuel injector inlet conduit 50 is inserted into primary sealing nut bore 70 from primary sealing nut second end 68*b* until fuel injector inlet conduit retention groove 50*b* is aligned with retention bores 90. Subsequently, retention pin legs 92*a* are inserted into retention bores 90 and fuel injector inlet conduit retention groove 50*b*, thereby retaining fuel injector 20 to fuel rail assembly 18. It should be noted that the preceding steps are carried out for each fuel rail distribution conduit 58 of fuel rail main conduit 54 and for each fuel injector 20 which is to be installed to fuel rail assembly 18. After each fuel injector 20 has been attached to fuel rail assembly 18, each fuel injector 20 is aligned with its respective fuel injector receiving bore 25 and inserted therein. Next, fuel rail mounting bolts 88 are threaded into cylinder head 26 and tightened, thereby clamping each fuel rail mounting boss 86 to cylinder head 26 and fixing the position of fuel rail assembly 18 to each fuel injector receiving bore 25. After fuel rail assembly 18 is fixed to cylinder head 26 by tightening fuel rail mounting bolts 88, primary sealing nut 68 is rotated to cause primary sealing nut 68 to move away from fuel rail main conduit 54. Since fuel rail main conduit 54 is fixed to cylinder head 26 and fuel injector 20 is restrained axially by fuel injector receiving bore shoulder 25*d*, movement of primary sealing nut 68 away from fuel rail main conduit 54 will cause primary sealing nut bore primary sealing surface 74 to be compressed against fuel injector inlet conduit sealing surface 50*a*. Primary sealing nut 68 is rotated in the direction of arrow B in FIG. 3 until a desired compressive force is generated between primary sealing nut bore primary sealing surface 74 and fuel injector inlet conduit sealing surface 50*a* which is sufficient to produce a leak-free interface between primary sealing nut bore primary sealing surface 74 and fuel injector inlet conduit sealing surface 50*a*. The necessary compressive force may be correlated to an applied torque to primary sealing nut 68, which may be determined, by way of non-limited example only, through empirical testing. Tightening of primary sealing nut 68 may be accomplished by engaging primary sealing nut hexagon periphery 68*c* with a wrench (not shown). After primary sealing nut 68 is tightened, secondary sealing nut 78 is rotated in the direction of arrow B to cause secondary sealing nut 78 to move toward primary sealing nut 68. Movement of secondary sealing nut 78 toward primary sealing nut 68 causes sealing ring 84 to be compressed axially, i.e. parallel to fuel rail distribution conduit axis 58*a*, between primary sealing nut 68 and secondary sealing nut 78. This axial compression of sealing ring 84 results in radial inward and radial outer expansion, i.e. radial relative to fuel rail distribution conduit axis 58*a*, of sealing ring 84 which provides radial compression circumferentially between sealing ring 84 and fuel rail distribution conduit sealing surface 66 and also provides radial compression circumferentially between sealing ring 84 and primary sealing nut counterbore peripheral surface 76*b*. Consequently, sealing ring 84 sealingly engages fuel rail distribution conduit sealing surface 66, thereby preventing fuel from passing therebetween and also sealingly engages primary sealing nut 68, thereby preventing fuel from passing therebetween. Secondary sealing nut 78 is preferably tightened to cause secondary sealing nut second end 78*b* to be compressed against primary sealing nut first end 68*a* and tightened to a predetermined torque which prevents secondary sealing nut 78 from loosening during use. This predetermined torque may be determined, by way of non-limited example only, through empirical testing. Tightening of secondary sealing nut 78 may be accomplished by engaging secondary sealing nut hexagon periphery 78*c* with a wrench (not shown). After secondary sealing nut 78 is tightened, a leak-free connection between fuel rail assembly 18 and fuel injector 20 complete.

Fuel rail assembly 18 as disclosed herein allows for metal-to-metal interfaces which provide the sealing necessary to withstand the high fuel pressures and extreme temperatures experienced during operation, without the need to rely on elastomeric seals which are susceptible to cuts, cracks, splits, abrasion, and wear during manufacture, assembly. Furthermore, the elements which provide fuel-tight sealing also provide the force which holds fuel injector 20 in compression against cylinder head 26, and consequently, a separate component is not needed to provide this function. Also furthermore, fuel rail assembly 18 accommodates angular misalignment between fuel injector 20 and fuel rail distribution conduit 58 while still maintaining the fuel-tight seal.

While the invention has been described by reference to various specific embodiments, it should be understood that numerous changes may be made within the spirit and scope of the inventive concepts described. Accordingly, it is intended that the invention not be limited to the described embodiments, but rather only to the extent set forth in the claims that follow.

We claim:

1. A fuel rail assembly which supplies fuel to a fuel injector of a fuel consuming device and which is configured to be fixed to said fuel consuming device, said fuel rail assembly comprising:

a fuel rail having 1) a fuel rail main conduit with a main fuel passage defined therein which is configured to receive fuel from a fuel source and 2) a fuel rail distribution conduit extending away from said fuel rail main conduit along a fuel rail distribution conduit axis, said fuel rail distribution conduit having a distribution passage extending therethrough which is in fluid communication with said main fuel passage, said fuel rail distribution conduit having a distribution conduit primary threaded section which is distal from said fuel rail main conduit, a distribution conduit secondary threaded section which is proximal to said fuel rail main conduit, and a distribution conduit sealing surface located axially between said distribution conduit primary threaded section and said distribution conduit secondary threaded section;

a primary sealing nut which includes a primary sealing nut bore extending therethrough along said fuel rail distribution conduit axis, said primary sealing nut extending from a primary sealing nut first end which is proximal to said fuel rail main conduit to a primary sealing nut second end which is distal from said fuel rail main conduit, said primary sealing nut bore having 1) a primary sealing nut bore threaded section which threadably engages said distribution conduit primary threaded section and 2) a primary sealing nut bore primary sealing surface located between said primary sealing nut bore threaded section and said primary sealing nut second end and configured to sealingly mate with said fuel injector when said primary sealing nut is rotated to cause said primary sealing nut to move away from said fuel rail main conduit;

a secondary sealing nut which includes a secondary sealing nut bore extending therethrough along said fuel rail distribution conduit axis, said secondary sealing nut extending from a secondary sealing nut first end which is proximal to said fuel rail main conduit to a secondary sealing nut second end which is distal from said fuel rail main conduit, said secondary sealing nut bore having a secondary sealing nut bore threaded section which threadably engages said distribution conduit secondary threaded section; and a sealing ring located within a counterbore of one of said primary sealing nut bore and said secondary sealing nut bore such that said sealing ring circumferentially surrounds said fuel rail distribution conduit, wherein said secondary sealing nut is configured to compress said sealing ring within said counterbore when said secondary sealing nut is rotated to cause said secondary sealing nut to move toward said primary sealing nut, thereby causing said sealing ring to sealingly engage said distribution conduit sealing surface and said primary sealing nut.

2. A fuel rail assembly as in claim 1, wherein said primary sealing nut bore primary sealing surface is frustoconical in shape.

3. A fuel rail assembly as in claim 1, wherein said sealing ring is a hollow toroid having an outer surface and an inner surface and a slot extending from said outer surface to said inner surface such that said slot is annular in shape and centered about said fuel rail distribution conduit axis and such that said slot provides fluid communication between said primary sealing nut bore threaded section and said inner surface.

4. A fuel rail assembly as in claim 3, wherein said slot is oriented to be approximately midway between radially inward toward said fuel rail distribution conduit axis and axially downward toward said primary sealing nut second end.

5. A fuel rail assembly as in claim 3, wherein:

said slot is oriented to be axially downward toward said primary sealing nut second end;

said counterbore includes an end surface which is travers to said fuel rail distribution conduit axis and a peripheral surface which circumferentially surrounds said fuel rail distribution conduit axis and which is cylindrical in shape; and said end surface includes radial and axial grooves extending thereinto which provide fluid communication between said primary sealing nut bore and said slot.

6. A fuel rail assembly as in claim 1, wherein said counterbore includes an end surface which is travers to said fuel rail distribution conduit axis and a peripheral surface which circumferentially surrounds said fuel rail distribution conduit axis and which is cylindrical in shape.

7. A fuel rail assembly as in claim 1, wherein said distribution conduit sealing surface is cylindrical and centered about said fuel rail distribution conduit axis.

8. A fuel rail assembly as in claim 1, wherein said sealing ring is a metal material which deforms when said secondary sealing nut is rotated to cause said compress said sealing ring within said counterbore when said secondary sealing nut is rotated to cause said secondary sealing nut to move toward said primary sealing nut.

9. A fuel rail assembly as in claim 1, wherein said distribution conduit secondary threaded section is smaller in diameter than said distribution conduit primary threaded section.

10. A fuel system for supplying fuel to a fuel consuming device, said fuel system comprising:

a fuel injector having a fuel injector inlet conduit, a nozzle opening, and a valve needle which is moveable to selectively permit and prevent flow of fuel from said fuel injector inlet conduit through said nozzle opening; and a fuel rail assembly comprising:

a fuel rail having 1) a fuel rail main conduit with a main fuel passage defined therein which is configured to receive fuel from a fuel source and 2) a fuel rail distribution conduit extending away from said fuel rail main conduit along a fuel rail distribution conduit axis, said fuel rail distribution conduit having a distribution passage extending therethrough which is in fluid communication with said main fuel passage, said fuel rail distribution conduit having a distribution conduit primary threaded section which is distal from said fuel rail main conduit, a distribution conduit secondary threaded section which is proximal to said fuel rail main conduit, and a distribution conduit sealing surface located axially between said distribution conduit primary threaded section and said distribution conduit secondary threaded section;

a primary sealing nut which includes a primary sealing nut bore extending therethrough along said fuel rail distribution conduit axis, said primary sealing nut extending from a primary sealing nut first end which is proximal to said fuel rail main conduit to a primary sealing nut second end which is distal from said fuel rail main conduit, said primary sealing nut bore having 1) a primary sealing nut bore threaded section which threadably engages said distribution conduit primary threaded section and 2) a primary sealing nut bore primary sealing surface located between said primary sealing nut bore threaded section and said primary sealing nut second end and configured to sealingly mate with a fuel injector inlet conduit sealing surface of said fuel injector inlet conduit when said primary sealing nut is rotated to cause said primary sealing nut to move away from said fuel rail main conduit;

a secondary sealing nut which includes a secondary sealing nut bore extending therethrough along said fuel rail distribution conduit axis, said secondary sealing nut extending from a secondary sealing nut first end which is proximal to said fuel rail main conduit to a secondary sealing nut second end which is distal from said fuel rail main conduit, said secondary sealing nut bore having a secondary sealing nut bore threaded section which threadably engages said distribution conduit secondary threaded section; and a sealing ring located within a counterbore of one of said primary sealing nut bore and said secondary sealing nut bore such that said sealing ring circumferentially surrounds said fuel rail distribution conduit, wherein said secondary sealing nut is configured to compress said sealing ring within said counterbore when said secondary sealing nut is rotated to cause said secondary sealing nut to move toward said primary sealing nut, thereby causing said sealing ring to sealingly engage said distribution conduit sealing surface and said primary sealing nut.

11. A fuel system as in claim 10, wherein said primary sealing nut bore primary sealing surface is frustoconical in shape and said fuel injector inlet conduit sealing surface is frustospherical in shape.

12. A fuel system as in claim 10, wherein said sealing ring is a hollow toroid having an outer surface and an inner surface and a slot extending from said outer surface to said inner surface such that said slot is annular in shape and centered about said fuel rail distribution conduit axis and such that said slot provides fluid communication between said primary sealing nut bore threaded section and said inner surface.

13. A fuel system as in claim 12, wherein said slot is oriented to be approximately midway between radially inward toward said fuel rail distribution conduit axis and axially downward toward said primary sealing nut second end.

14. A fuel system as in claim 10, wherein said counterbore includes an end surface which is travers to said fuel rail distribution conduit axis and a peripheral surface which circumferentially surrounds said fuel rail distribution conduit axis and which is cylindrical in shape.

15. A fuel system as in claim 10, wherein said distribution conduit sealing surface is cylindrical and centered about said fuel rail distribution conduit axis.

16. A fuel system as in claim 10, wherein said sealing ring is a metal material which elastically deforms when said secondary sealing nut is rotated to cause said compress said sealing ring within said counterbore when said secondary sealing nut is rotated to cause said secondary sealing nut to move toward said primary sealing nut.

17. A fuel system as in claim 10, wherein said distribution conduit secondary threaded section is smaller in diameter than said distribution conduit primary threaded section.

18. A fuel rail assembly which supplies fuel to a fuel injector of a fuel consuming device and which is configured to be fixed to said fuel consuming device, said fuel rail assembly comprising:

a fuel rail having 1) a fuel rail main conduit with a main fuel passage defined therein which is configured to receive fuel from a fuel source and 2) a fuel rail distribution conduit extending away from said fuel rail main conduit along a fuel rail distribution conduit axis, said fuel rail distribution conduit having a distribution passage extending therethrough which is in fluid communication with said main fuel passage, said fuel rail distribution conduit having a distribution conduit primary threaded section which is distal from said fuel rail main conduit, a distribution conduit secondary threaded section which is proximal to said fuel rail main conduit, and a distribution conduit sealing surface located axially between said distribution conduit primary threaded section and said distribution conduit secondary threaded section.

19. A fuel rail assembly as in claim 18, further comprising:

a primary sealing nut which includes a primary sealing nut bore extending therethrough said primary sealing nut bore having 1) a primary sealing nut bore threaded section which threadably engages said distribution conduit primary threaded section and 2) a primary sealing nut bore primary sealing surface configured to sealingly mate with said fuel injector;

a secondary sealing nut which includes a secondary sealing nut bore extending therethrough which threadably engages said distribution conduit secondary threaded section; and a sealing ring located within a counterbore of one of said primary sealing nut bore and said secondary sealing nut bore such that said sealing ring circumferentially surrounds said distribution conduit sealing surface.

20. A fuel rail assembly as in claim 19, wherein said counterbore includes an end surface which is travers to said fuel rail distribution conduit axis and a peripheral surface which circumferentially surrounds said fuel rail distribution conduit axis and which is cylindrical in shape such that said sealing ring seals radially against said peripheral surface when said secondary sealing nut is tightened against said primary sealing nut.

* * * * *